US011542619B2

(12) United States Patent
Tsuji

(10) Patent No.: US 11,542,619 B2
(45) Date of Patent: Jan. 3, 2023

(54) PLATING METHOD

(71) Applicant: EBARA CORPORATION, Tokyo (JP)

(72) Inventor: Kazuhito Tsuji, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 3 days.

(21) Appl. No.: 17/497,252

(22) Filed: Oct. 8, 2021

(65) Prior Publication Data

US 2022/0112620 A1 Apr. 14, 2022

(30) Foreign Application Priority Data

Oct. 9, 2020 (JP) ..... JP2020-171311

(51) Int. Cl.

| | |
|---|---|
| ***C25D 5/34*** | (2006.01) |
| ***C25D 7/12*** | (2006.01) |
| ***C25D 21/12*** | (2006.01) |
| ***C25D 17/00*** | (2006.01) |

(52) U.S. Cl.

CPC ..... *C25D 5/34* (2013.01); *C25D 7/123* (2013.01); *C25D 17/001* (2013.01); *C25D 21/12* (2013.01)

(58) Field of Classification Search

CPC ..... C25D 5/34

See application file for complete search history.

(56) References Cited

U.S. PATENT DOCUMENTS

2015/0096883 A1* 4/2015 Mayer ..... C25D 5/003 204/227

FOREIGN PATENT DOCUMENTS

JP 2001-316869 A 11/2001
JP 2004269923 A * 9/2004

OTHER PUBLICATIONS

Kuriyama et al., Machine Translation, JP 2004-269923 A (Year: 2004).*

* cited by examiner

*Primary Examiner* — Ho-Sung Chung
(74) *Attorney, Agent, or Firm* — BakerHostetler

(57) ABSTRACT

An objective of the present invention is to prevent a prewetting liquid from remaining in an edge portion of a substrate. A plating method for subjecting a substrate to a plating treatment is provided, the substrate including a part to be plated that is exposed to a plating solution and an edge portion that is an outer region of the part to be plated. The plating method includes a first sealing step of bringing a first seal body into contact with the substrate to seal the edge portion of the substrate, a prewetting step of subjecting the sealed substrate to a prewetting treatment, a first seal removing step of removing the first seal body from the prewetted substrate, a substrate holding step of holding the substrate with a substrate holder including a second seal body, and a plating step of applying the plating solution to the substrate held by the substrate holder.

10 Claims, 10 Drawing Sheets

1000

PLATING METHOD

TECHNICAL FIELD

The present application relates to a plating method.

BACKGROUND ART

As a plating module for subjecting a substrate to a plating treatment, a cup type electroplating module is known. The cup type electroplating module includes a substrate holder that holds a substrate (e.g., a semiconductor wafer) with a surface to be plated being oriented downward. The substrate holder includes an electrical contact point for applying a voltage to the substrate, and a sealing member that seals the substrate so that a plating solution does not act on this electrical contact point. In the cup type electroplating module, the substrate is immersed into the plating solution with the surface to be plated being oriented downward, and the voltage is applied between the substrate and an anode, thereby precipitating a conductive film on a substrate surface.

A plating apparatus for treating a plurality of substrates may include a plurality of such cup type electroplating modules. In this example, each of the plurality of cup type electroplating modules may include a substrate holder and a plating tank that are integrated. The plating tank and the substrate holder are integrally configured, and accordingly size reduction of the apparatus can be achieved.

CITATION LIST

Patent Literature

PTL 1: Japanese Patent Laid-Open No. 2001-316869

SUMMARY OF INVENTION

Technical Problem

In a plating apparatus, a substrate may be subjected to a prewetting treatment prior to a plating treatment in a plating module. In the prewetting treatment, a surface to be plated of the substrate prior to the plating treatment is wetted with a treatment liquid such as pure water or de-aired water, to replace air inside a pattern formed on a substrate surface with the treatment liquid. Consequently, during plating, the treatment liquid inside the pattern is replaced with a plating solution, and hence the plating solution can be easily supplied to an interior of the pattern. However, in a case where the prewetting treatment is performed before the substrate is held with a substrate holder as in, for example, an apparatus in which the substrate holder and a plating tank are integrated, a disadvantage might be caused.

Specifically, the prewetting treatment is performed before the substrate is held by the substrate holder, and a prewetting liquid remains in an edge portion of the substrate with which an electrical contact point comes in contact. In this case, there is concern that electrical contact with the electrical contact point is obstructed when the substrate is held by the substrate holder. Also, the plating solution used in a previous plating treatment might be adhered to the substrate holder. In this case, there is concern that, if the prewetting liquid remains in the edge portion of the substrate, the plating solution enters a sealing region.

In view of above-described situations, one object of the present application is to prevent a prewetting liquid from remaining in an edge portion of a substrate.

Solution to Problem

According to an embodiment, a plating method for subjecting a substrate to a plating treatment is provided, the substrate including a part to be plated that is exposed to a plating solution and an edge portion that is an outer region of the part to be plated, the plating method including a first sealing step of bringing a first seal body into contact with the substrate to seal the edge portion of the substrate, a prewetting step of subjecting, to a prewetting treatment, the substrate sealed by the first sealing step, a first seal removing step of removing the first seal body from the prewetted substrate, a substrate holding step of holding the substrate with a substrate holder including a second seal body, and a plating step of applying the plating solution to the substrate held by the substrate holder.

DESCRIPTION OF EMBODIMENTS

Figure 1:
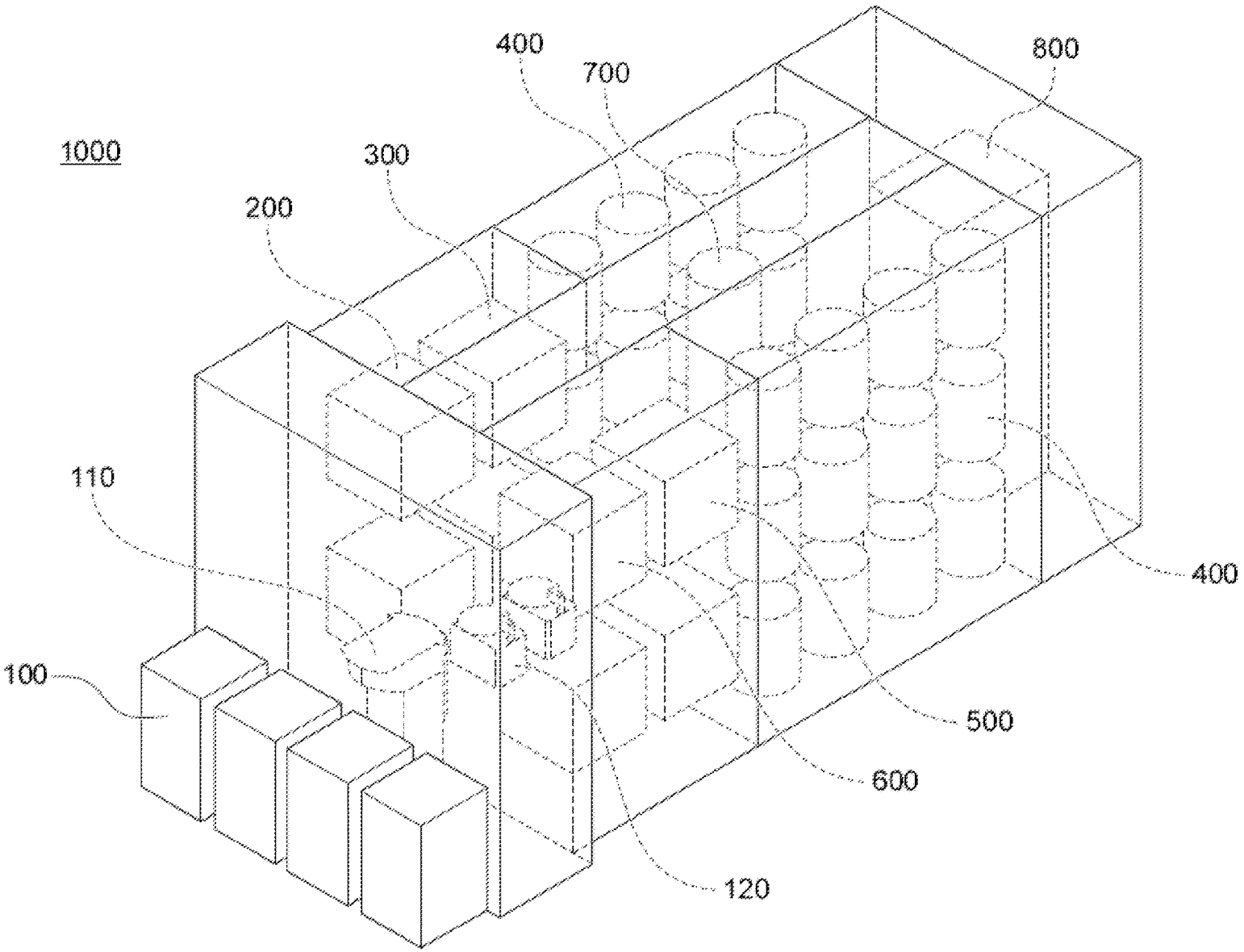
FIG. 1 is a perspective view showing an overall configuration of a plating apparatus of a present embodiment.

Hereinafter, description will be made as to embodiments of the present invention with reference to the drawings. In the drawings illustrated below, the same or corresponding constituent component is denoted with the same reference sign, and redundant description will not be repeated.

<Overall Configuration of Plating Apparatus>

Figure 2:
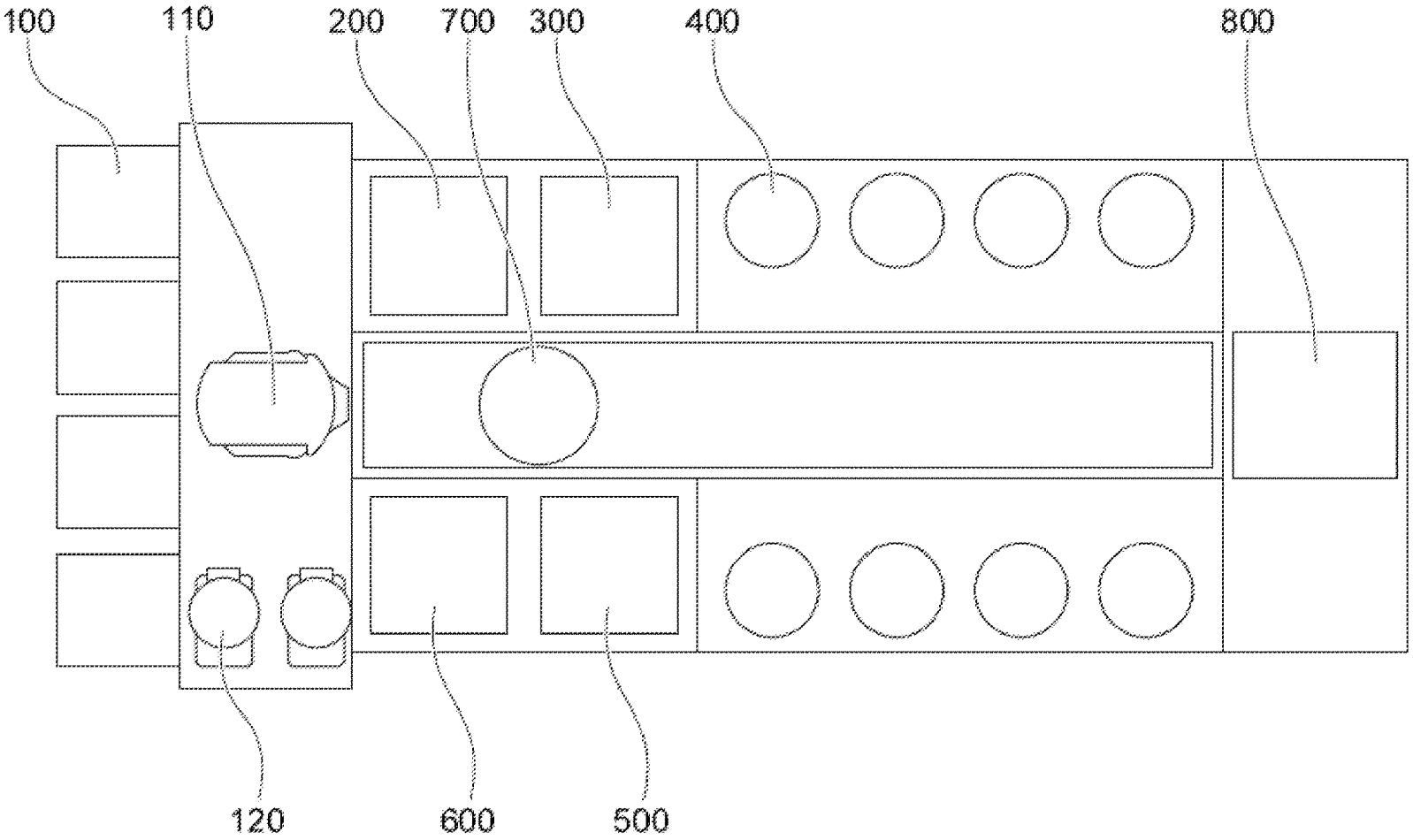
FIG. 2 is a plan view showing the overall configuration of the plating apparatus of the present embodiment.

FIG. 1 is a perspective view showing an overall configuration of a plating apparatus of the present embodiment. FIG. 2 is a plan view showing the overall configuration of the plating apparatus of the present embodiment. The plating apparatus of the present embodiment is for use in subjecting a substrate to a plating treatment. Examples of the substrate include a square substrate and a circular substrate. As shown in FIGS. 1 and 2, a plating apparatus 1000 includes a loading/unloading module 100, a transfer robot 110, an aligner 120, a prewetting module 200, a presoaking module 300, a plating module 400, a washing module 500, a spin rinse dryer module 600, a transfer device 700, and a control module 800.

The loading/unloading module 100 is a module for loading a substrate such as a semiconductor wafer into the plating apparatus 1000 and unloading the substrate from the plating apparatus 1000, and a cassette for housing the substrate is mounted on the module. In the present embodiment, four loading/unloading modules 100 are arranged in a horizontal direction, but the number and arrangement of the loading/unloading modules 100 are arbitrary. The transfer robot 110 is a robot for transferring the substrate, and configured to deliver the substrate among the loading/unloading module 100, the aligner 120, and the transfer device 700. The transfer robot 110 and the transfer device 700 can deliver the substrate via an unshown temporary stand, when delivering the substrate between the transfer robot 110 and the transfer device 700. The aligner 120 is a module for aligning positions of an orientation flat, a notch and the like of the substrate in a predetermined direction. In the present embodiment, two aligners 120 are arranged in the horizontal direction, but the number and arrangement of the aligners 120 are arbitrary.

The prewetting module 200 is a module for adhering a treatment liquid (prewetting liquid) such as pure water or de-aired water to a surface to be treated of the substrate prior to the plating treatment. In the present embodiment, two prewetting modules 200 are arranged in an up-down direction, but the number and arrangement of the prewetting modules 200 are arbitrary. The presoaking module 300 is a module for etching an oxide film on the surface to be plated of the substrate prior to the plating treatment. In the present embodiment, two presoaking modules 300 are arranged in the up-down direction, but the number and arrangement of the presoaking modules 300 are arbitrary.

The plating module 400 is a module for subjecting the substrate to the plating treatment. In the present embodiment, there are two sets of twelve plating modules 400, each set including three plating modules arranged in the up-down direction and four plating modules arranged in the horizontal direction, and 24 plating modules 400 in total are provided. The number and arrangement of the plating modules 400 are arbitrary.

The washing module 500 is a module for washing the substrate subjected to the plating treatment. In the present embodiment, two washing modules 500 are arranged in the up-down direction, but the number and arrangement of the washing modules 500 are arbitrary. The spin rinse dryer module 600 is a module for rotating the substrate subjected to a washing treatment at a high speed to dry the substrate. In the present embodiment, two spin rinse dryer modules are arranged in the up-down direction, but the number and arrangement of the spin rinse dryer modules are arbitrary.

The transfer device 700 is a device for transferring the substrate among a plurality of modules in the plating apparatus 1000. The control module 800 is a module for controlling the plurality of modules of the plating apparatus 1000, and may include a general computer or a dedicated computer including, for example, an input/output interface between the computer and an operator.

An example of a series of plating treatments by the plating apparatus 1000 will be described. First, the substrate is loaded into the loading/unloading module 100. Subsequently, the transfer robot 110 removes the substrate from the loading/unloading module 100, and transfers the substrate to the aligner 120. The aligner 120 aligns the positions of the orientation flat, notch and the like in the predetermined direction. The transfer robot 110 delivers, to the transfer device 700, the substrate aligned in the direction by the aligner 120.

The transfer device 700 transfers, to the prewetting module 200, the substrate received from the transfer robot 110. The prewetting module 200 subjects the substrate to a prewetting treatment. The transfer device 700 transfers, to the presoaking module 300, the substrate subjected to the prewetting treatment. The presoaking module 300 subjects the substrate to a presoaking treatment. The transfer device 700 transfers, to the plating module 400, the substrate subjected to the presoaking treatment. The plating module 400 subjects the substrate to the plating treatment.

The transfer device 700 transfers, to the washing module 500, the substrate subjected to the plating treatment. The washing module 500 subjects the substrate to the washing treatment. The transfer device 700 transfers the substrate subjected to the washing treatment to the spin rinse dryer module 600. The spin rinse dryer module 600 subjects the substrate to a drying treatment. The transfer device 700 delivers the substrate subjected to the drying treatment to the transfer robot 110. The transfer robot 110 transfers the substrate received from the transfer device 700 to the loading/unloading module 100. Finally, the substrate is unloaded from the loading/unloading module 100.

<Configuration of Plating Module>

Figure 3:
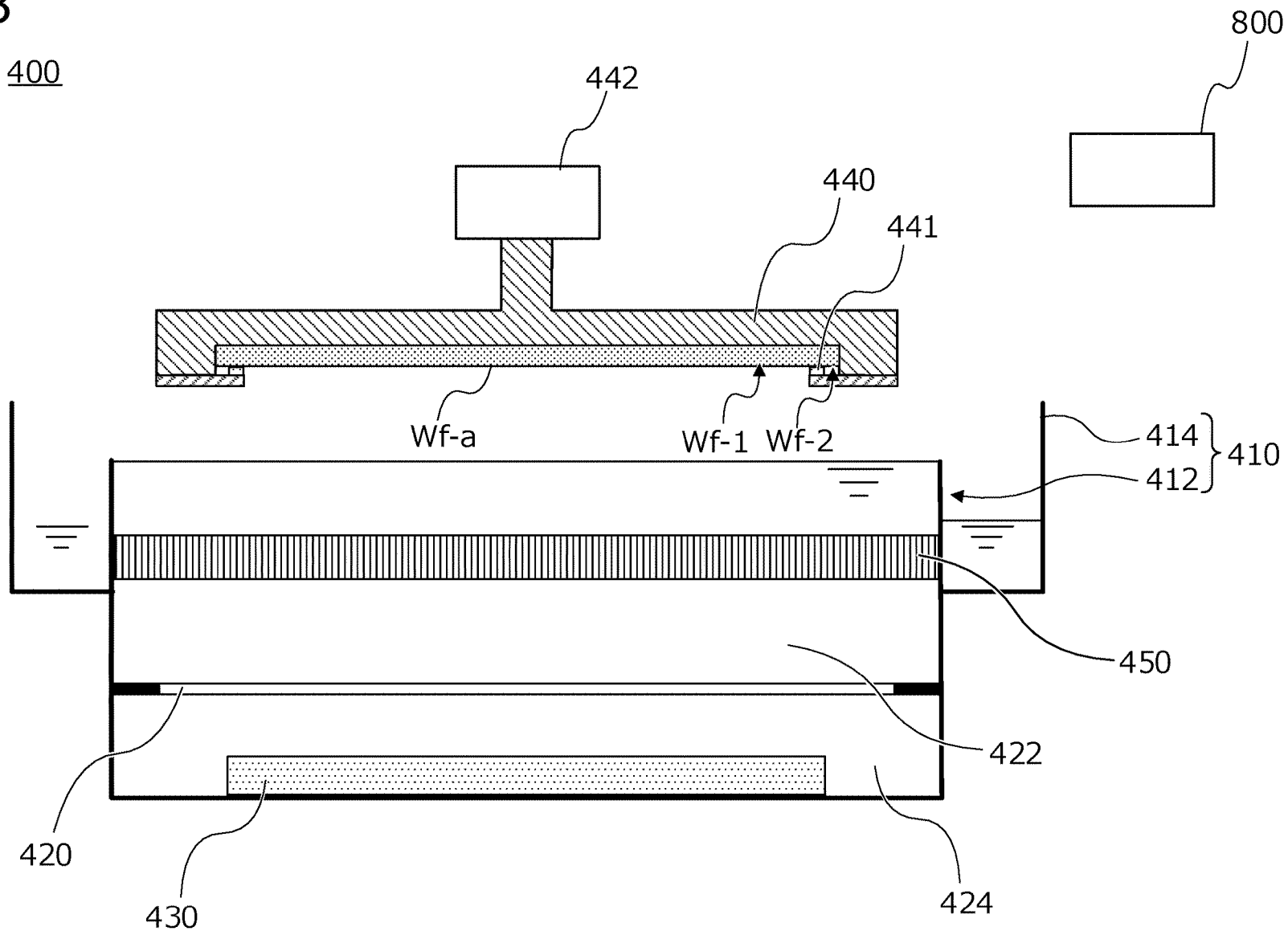
FIG. 3 is a longitudinal sectional view schematically showing a configuration of a plating module of the present embodiment.

Next, a configuration of the plating module 400 will be described. The 24 plating modules 400 in the present embodiment have the same configuration, and hence one plating module 400 will only be described. FIG. 3 is a longitudinal sectional view schematically showing the configuration of the plating module 400 of the present embodiment. As shown in FIG. 3, the plating module 400 includes a plating tank 410 for storing the plating solution. The plating tank 410 includes a cylindrical inner tank 412 having an opened upper surface, and an outer tank 414 disposed around the inner tank 412 to accumulate the plating solution that overflows from an upper edge of the inner tank 412.

The plating module 400 includes a membrane 420 that separates an interior of the inner tank 412 in the up-down direction. The interior of the inner tank 412 is separated into a cathode region 422 and an anode region 424 by the membrane 420. Each of the cathode region 422 and the anode region 424 is filled with the plating solution. An anode 430 is disposed on a bottom surface of the inner tank 412 of the anode region 424. In the cathode region 422, a resistor 450 facing the membrane 420 is disposed. The resistor 450 is a member for uniformly performing the plating treatment in a surface to be plated Wf-a of a substrate Wf. Note that in the present embodiment, an example where the membrane 420 is disposed has been described, but the membrane 420 does not have to be disposed.

Also, the plating module 400 includes a substrate holder 440 for holding the substrate Wf in a state where the surface to be plated Wf-a is oriented downward. In a state where a part (part to be plated) Wf-1 in the surface to be plated Wf-a is exposed, an edge portion Wf-2 that is an outer region of the part is grasped by the substrate holder 440. The substrate holder 440 includes a seal body (second seal body) 441 that seals the edge portion Wf-2 so that the plating solution does not act on the edge portion Wf-2 of the substrate Wf. The substrate holder 440 also includes a power supply contact point that comes in contact with the edge portion Wf-2 of the substrate Wf to supply power from an unshown power source to the substrate Wf. The plating module 400 includes an elevating/lowering mechanism 442 for elevating and lowering the substrate holder 440. The elevating/lowering mechanism 442 can be achieved by a known mechanism such as a motor. The substrate Wf is immersed into the plating solution of the cathode region 422 by use of the elevating/lowering mechanism 442, the part to be plated Wf-1 of the substrate Wf is exposed to the plating solution. The plating module 400 is configured to subject the surface to be plated Wf-a (the part to be plated Wf-1) of the substrate Wf to the plating treatment by applying a voltage between the anode 430 and the substrate Wf in this state.

Note that it has been described above that in the plating module 400, the substrate Wf is subjected to the plating treatment in the state where the surface to be plated Wf-a is oriented downward, but the present invention is not limited to this example. As an example, the plating module 400 may perform the plating treatment in a state where the surface to be plated Wf-a is oriented upward or to a side.

<Configuration of Prewetting Module>

Figure 4:
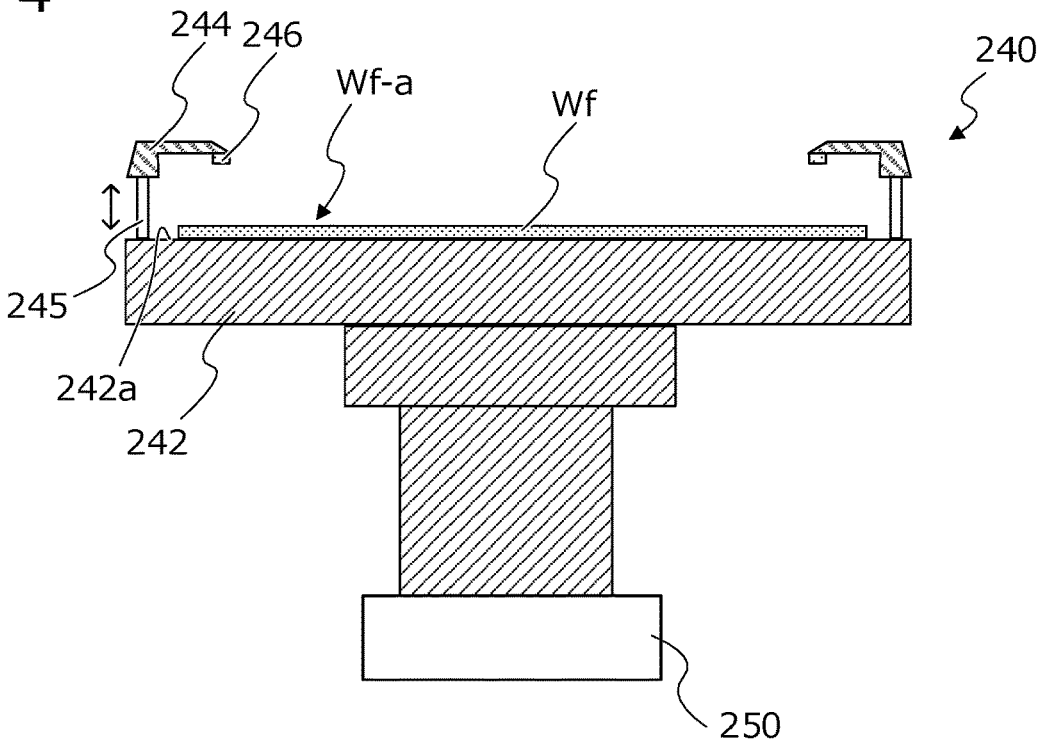
FIG. 4 is a longitudinal sectional view schematically showing a configuration of a prewetting module of the present embodiment.

A configuration of the prewetting module 200 of the present embodiment will be described. Two prewetting modules 200 in the present embodiment have the same configuration, and hence one prewetting module 200 is only described. FIG. 4 is a longitudinal sectional view schematically showing the configuration of the prewetting module 200 of the present embodiment. As shown in FIG. 4, the prewetting module 200 includes a prewetting substrate holder 240 for holding the substrate Wf, and a drive mechanism 250 for driving the prewetting substrate holder 240. Also, the prewetting module 200 includes a treatment liquid supply mechanism (not shown in FIG. 4) for supplying a treatment liquid such as pure water or de-aired water. Note that in an example shown in FIG. 4, the prewetting substrate holder 240 holds the substrate Wf in a state where the surface to be plated Wf-a is oriented upward, but the present invention is not limited to this example. The prewetting substrate holder 240 may be configured to hold the substrate with the surface to be plated Wf-a being oriented downward or in the horizontal direction. Alternatively, the prewetting substrate holder 240 may hold the substrate with the surface to be plated Wf-a being tilted in a vertical direction or the horizontal direction. As an example, the drive mechanism 250 is configured to move the prewetting substrate holder 240 in at least one of the horizontal direction and the vertical direction. Alternatively, the drive mechanism 250 may be configured to change the orientation of the surface to be plated Wf-a, or may be configured to turn the substrate Wf upside down.

The prewetting substrate holder 240 includes, for example, a first holding member (supporter) 242 including a support surface 242*a* for supporting a back surface of the surface to be plated Wf-a of the substrate Wf, and a second holding member 244 configured to be detachably attached to the first holding member 242. As an example, the prewetting substrate holder 240 is configured to hold the substrate Wf by moving, to the first holding member 242, a pin 245 attached to the second holding member 244 by an unshown drive mechanism, and holding the substrate Wf between the first holding member 242 and a seal body 246. However, the present invention is not limited to this example, and the prewetting substrate holder 240 may be configured to hold the substrate with a vacuum chuck disposed in the first holding member 242.

Figure 5:
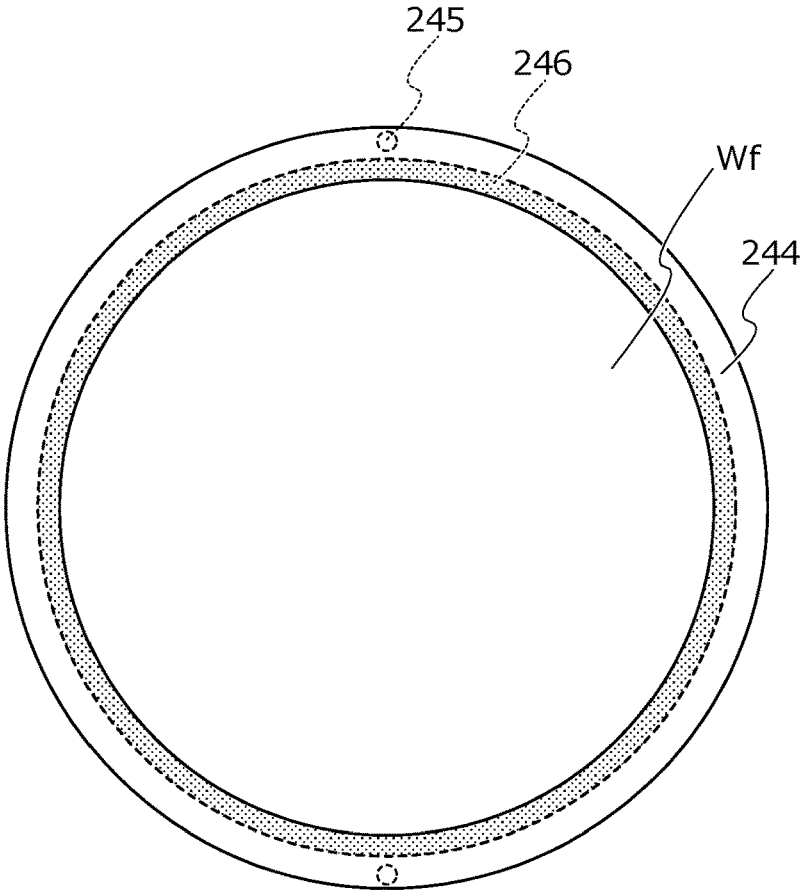
FIG. 5 is a view showing a second holding member from above in FIG. 4.

The second holding member 244 comes in contact with the surface to be plated Wf-a of the substrate Wf, and forms a stepped portion to the surface to be plated Wf-a. As an example, the stepped portion formed by the second holding member 244 may be formed in a tapered shape with a diameter increasing as being away from the surface to be plated Wf-a of the substrate Wf, as shown in FIG. 4. FIG. 5 is a view showing the second holding member 244 from above in FIG. 4. As shown in FIGS. 4 and 5, the second holding member 244 includes the seal body (a first seal body) 246 (shown with a dashed line in FIG. 5) that comes in contact with the surface to be plated Wf-a of the substrate Wf to seal the edge portion Wf-2 of the substrate Wf. The seal body 246 prevents the prewetting liquid from entering the edge portion Wf-2 of the substrate Wf in the surface to be plated Wf-a. In addition, for example, in a case where the prewetting liquid is unlikely to enter a gap between the first holding member 242 and the second holding member 244, the prewetting substrate holder 240 does not have to include a seal body for sealing the gap between the first holding member 242 and the second holding member 244, as shown in FIG. 4. However, the present invention is not limited to this example, and at least one of the first holding member 242 and the second holding member 244 may include a seal body for sealing the gap between the first holding member 242 and the second holding member 244.

Figure 6:
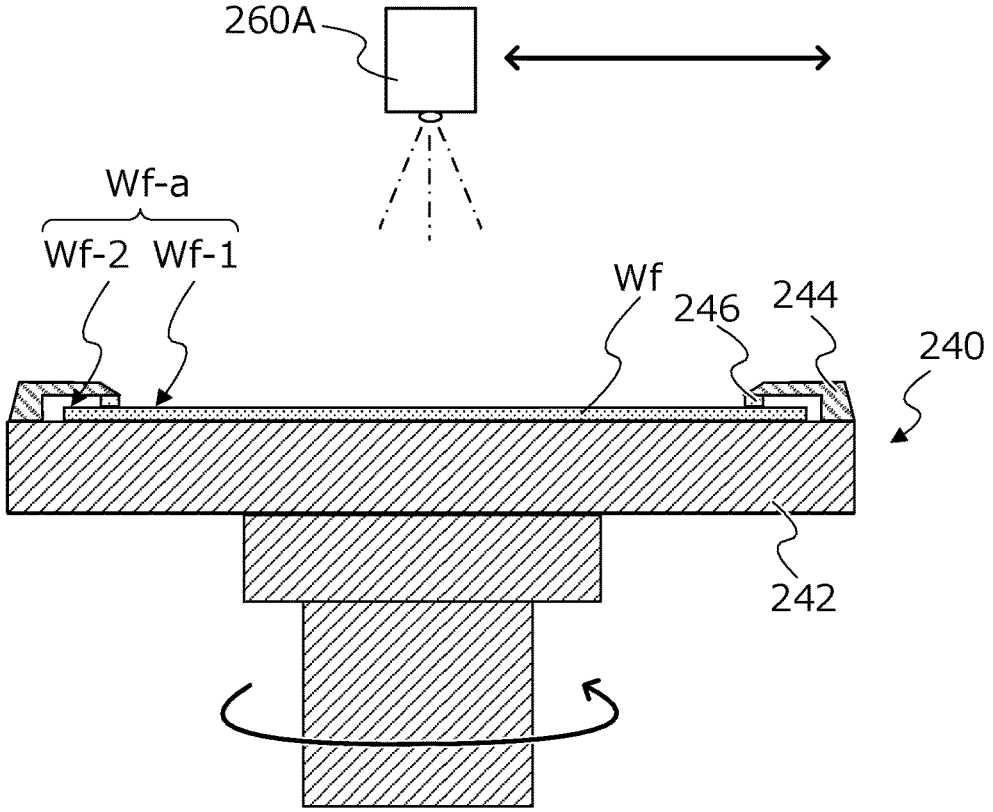
FIG. 6 is a view showing a prewetting treatment of a first embodiment by the prewetting module.

Subsequently, the prewetting treatment of the substrate Wf by the prewetting module 200 will be described. FIG. 6 is a view showing a prewetting treatment of a first embodiment by the prewetting module 200. In an example shown in FIG. 6, the substrate Wf is held so that the surface to be plated Wf-a faces upward. Also, in the example shown in FIG. 6, the prewetting module 200 includes, as a treatment liquid supply mechanism, a jetting mechanism (nozzle) 260A configured to jet the treatment liquid from above the substrate Wf. The treatment liquid is jetted from the jetting mechanism 260A, and accordingly the treatment liquid is sprayed and adhered to the surface to be plated Wf-a (the part to be plated Wf-1) of the substrate Wf. The present invention includes but is not limited to an example where the treatment liquid is sprayed to the surface to be plated Wf-a of the substrate Wf in response to rotation of the prewetting substrate holder 240 (the substrate Wf) by the drive mechanism 250 (not shown in FIG. 6). In this example, uniformity in adhesion of the treatment liquid on the surface to be plated Wf-a can be improved. Alternatively, the jetting mechanism 260A that jets the treatment liquid may be configured to spray the treatment liquid toward a center of the substrate Wf, or may be configured to spray the treatment liquid toward a predetermined position away from the center of the substrate Wf. Furthermore, the treatment liquid may be jetted from the jetting mechanism 260A in response to movement of at least one of the prewetting substrate holder 240 and the jetting mechanism 260A to perform the jetting while changing a spray position in the surface to be plated Wf-a.

Figure 7:
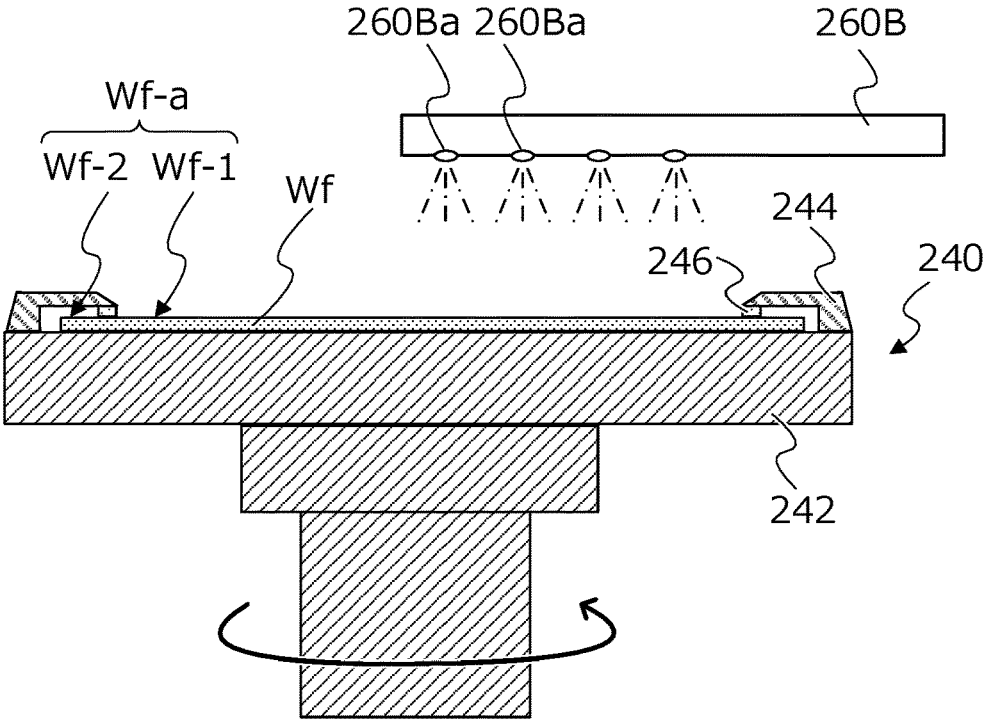
FIG. 7 is a view showing a prewetting treatment of a second embodiment by the prewetting module.

FIG. 7 is a view showing a prewetting treatment of a second embodiment by the prewetting module 200. In an example shown in FIG. 7, the substrate Wf is held so that the surface to be plated Wf-a faces upward. Also, in the example shown in FIG. 7, the prewetting module 200 includes, as a treatment liquid supply mechanism, a jetting mechanism 260B configured to jet the treatment liquid from above the substrate Wf. The jetting mechanism 260B includes a plurality of jetting ports 260Ba. As an example, the jetting mechanism 260B may include a plurality of jetting ports 260Ba along a radial direction of the surface to be plated Wf-a of the substrate Wf, and the treatment liquid may be jetted from the jetting mechanism 260B in response to rotation of the substrate Wf. Also, in this example, the surface to be plated Wf-a of the substrate Wf can be suitably subjected to the prewetting treatment. In addition, the treatment liquid may be jetted from the jetting mechanism 260B in response to movement of at least one of the prewetting substrate holder 240 and the jetting mechanism 260B to perform the jetting while changing the spray position in the surface to be plated Wf-a.

Figure 8:
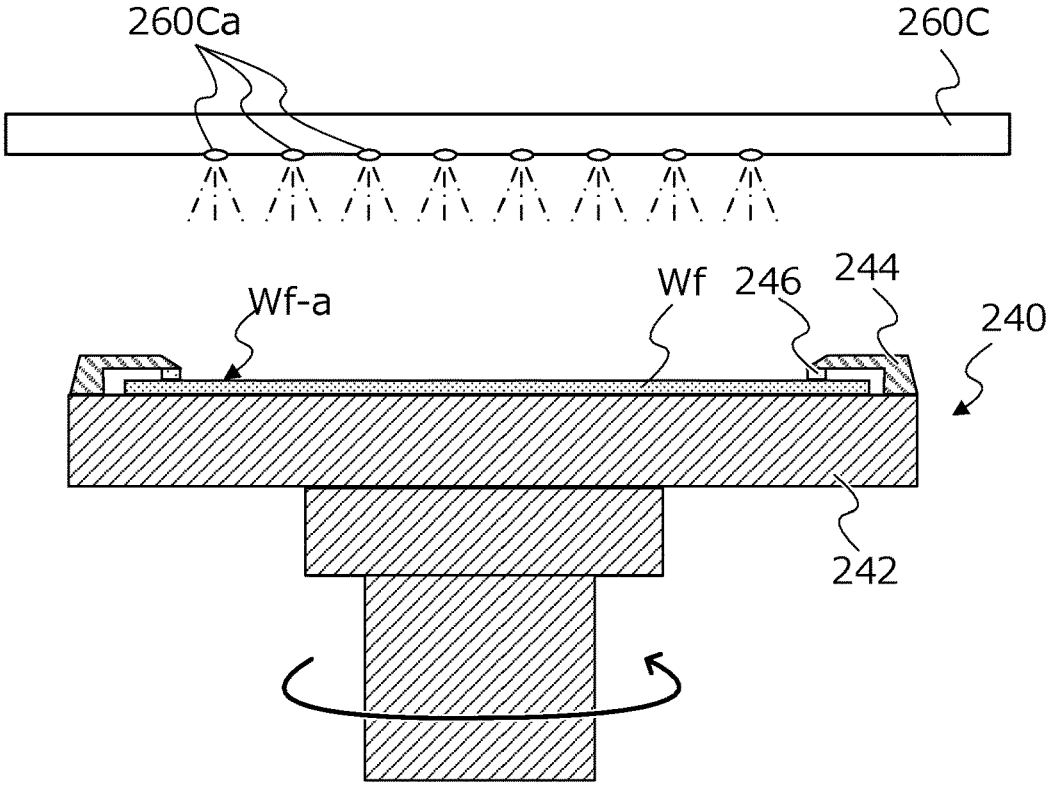
FIG. 8 is a view showing a prewetting treatment of a third embodiment by the prewetting module.

FIG. 8 is a view showing a prewetting treatment of a third embodiment by the prewetting module 200. In an example shown in FIG. 8, the substrate Wf is held so that the surface to be plated Wf-a faces upward. In the example shown in FIG. 8, the prewetting module 200 includes, as a treatment liquid supply mechanism, a jetting mechanism 260C configured to jet a treatment liquid from above the substrate Wf. Here, the jetting mechanism 260C shown in FIG. 8 includes a plurality of jetting ports 260Ca. As an example, the jetting mechanism 260C includes the plurality of jetting ports 260Ca facing the surface to be plated Wf-a over an entire area of the part to be plated Wf-1 of the substrate Wf. Also, in this example, the surface to be plated Wf-a of the substrate Wf can be suitably subjected to the prewetting treatment. In addition, the treatment liquid may be jetted from the jetting mechanism 260C in response to movement of at least one of the prewetting substrate holder 240 and the jetting mechanism 260C to perform the jetting while changing the spray position in the surface to be plated Wf-a. Alternatively, when the treatment liquid is jetted from the jetting mechanism 260C, the substrate Wf may be rotated.

Figure 9:
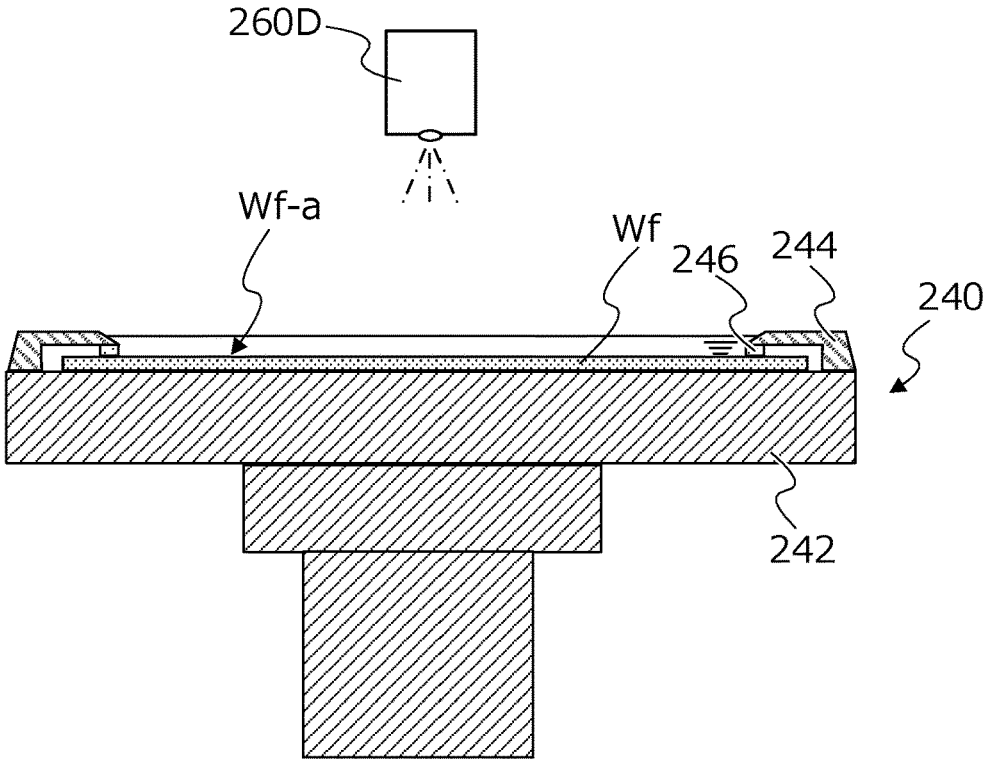
FIG. 9 is a view showing a prewetting treatment of a fourth embodiment by the prewetting module.

FIG. 9 is a view showing a prewetting treatment of a fourth embodiment by the prewetting module 200. In an example shown in FIG. 9, the substrate Wf is held so that the surface to be plated Wf-a faces upward. In the example shown in FIG. 9, a treatment liquid supply mechanism 260D of the prewetting module 200 accumulates a treatment liquid in a tank-shaped region defined by the second holding member 244 (the first seal body 246 and a stepped portion) of the prewetting substrate holder 240 and the surface to be plated Wf-a. As an example, the prewetting module 200 may adhere the treatment liquid to the surface to be plated Wf-a by operating the treatment liquid supply mechanism 260D to accumulate a predetermined amount of treatment liquid in the tank-shaped region, and then being on standby for a predetermined time. According to this example, a small amount of treatment liquid can be uniformly adhered to the surface to be plated Wf-a.

Figure 10:
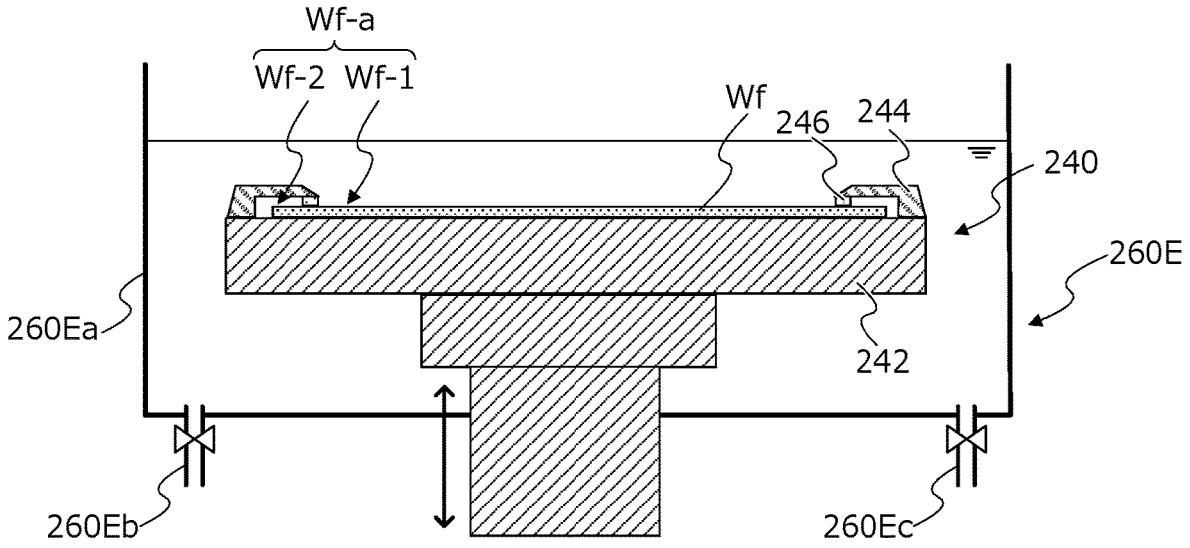
FIG. 10 is a view showing a prewetting treatment of a fifth embodiment by the prewetting module.

FIG. 10 is a view showing a prewetting treatment of a fifth embodiment by the prewetting module 200. In an example shown in FIG. 10, the substrate Wf is held so that the surface to be plated Wf-a faces upward. In the example shown in FIG. 10, the prewetting module 200 includes, as a treatment liquid supply mechanism 260E, a prewetting tank 260Ea for storing a treatment liquid, a treatment liquid supply line 260Eb for supplying the treatment liquid to the prewetting tank 260Ea, and a treatment liquid discharge line 260Ec for discharging the treatment liquid from the prewetting tank 260Ea. In the example shown in FIG. 10, the treatment liquid is adhered to the part to be plated Wf-1 of the substrate Wf by immersing the prewetting substrate holder 240 holding the substrate Wf into the treatment liquid accumulated in the prewetting tank 260Ea by use of the drive mechanism 250 (not shown in FIG. 10). Alternatively, the prewetting module 200 may adhere the treatment liquid to the substrate Wf by moving the prewetting substrate holder 240 into the prewetting tank 260Ea, and then supplying the treatment liquid from the treatment liquid supply line 260Eb into the prewetting tank 260Ea. Alternatively, the prewetting module 200 may adhere the treatment liquid to the substrate Wf by moving the prewetting substrate holder 240 into the prewetting tank 260Ea in a state where the treatment liquid is accumulated in the prewetting tank 260Ea. In addition, in the example shown in FIG. 10, the prewetting module 200 may include one of the jetting mechanisms 260A to 260C shown in FIGS. 6 to 8 in place of or in addition to the treatment liquid supply line 260Eb.

Figure 11:
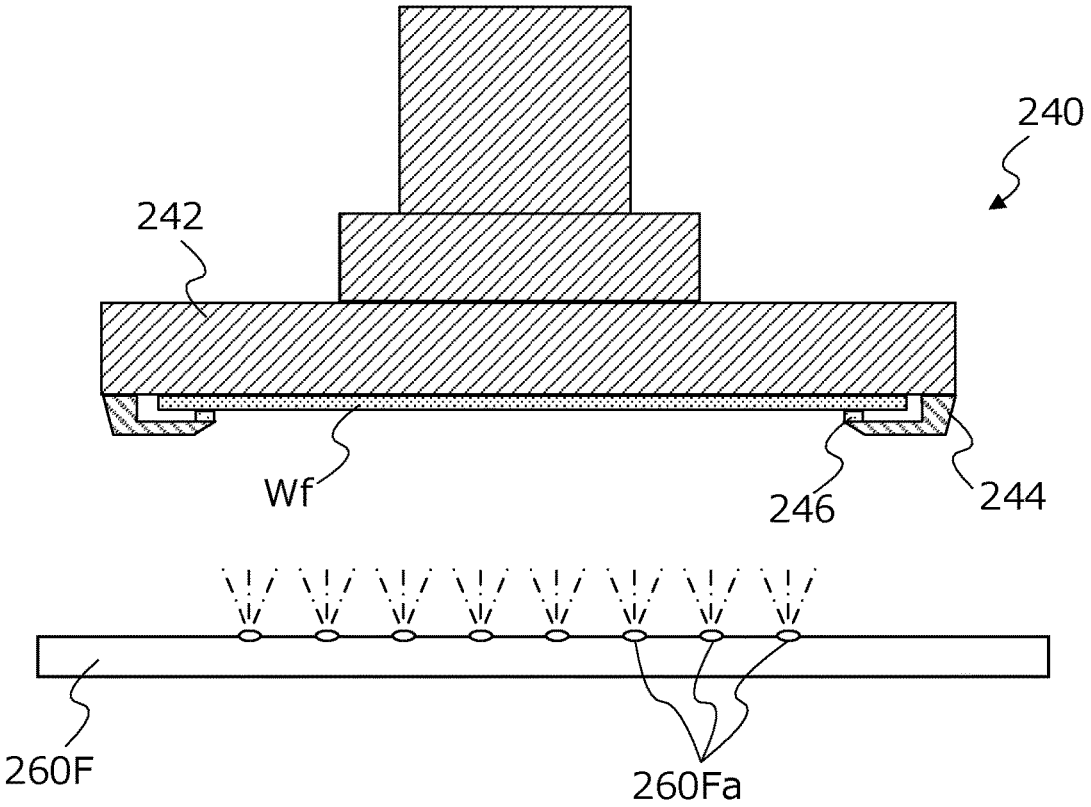
FIG. 11 is a view showing a prewetting treatment of a sixth embodiment by the prewetting module.

FIG. 11 is a view showing a prewetting treatment of a sixth embodiment by the prewetting module 200. In an example shown in FIG. 11, the substrate Wf is held so that the surface to be plated Wf-a faces downward. In the example shown in FIG. 11, the prewetting module 200 includes, as a treatment liquid supply mechanism, a jetting mechanism 260F configured to jet a treatment liquid from below the substrate Wf. Here, the jetting mechanism 260F shown in FIG. 11 includes a plurality of jetting ports 260Fa. As an example, the jetting mechanism 260F includes the plurality of jetting ports 260Fa facing the surface to be plated Wf-a over an entire area of the part to be plated Wf-1 of the substrate Wf. Also, in this example, the surface to be plated Wf-a of the substrate Wf can be suitably subjected to the prewetting treatment. In addition, the treatment liquid may be jetted from the jetting mechanism 260F in response to movement of at least one of the prewetting substrate holder 240 and the jetting mechanism 260F to jet the treatment liquid while changing a spray position in the surface to be plated Wf-a. Alternatively, when the treatment liquid is jetted from the jetting mechanism 260F, the substrate Wf may be rotated. Furthermore, the present invention is not limited to the example shown in FIG. 11, and the jetting mechanism 260F may include one jetting port as in the jetting mechanism 260A described with reference to FIG. 6. Also, the jetting mechanism 260F may include a plurality of jetting ports along a radial direction of the surface to be plated Wf-a of the substrate Wf as in the jetting mechanism 260B described with reference to FIG. 7.

Figure 12:
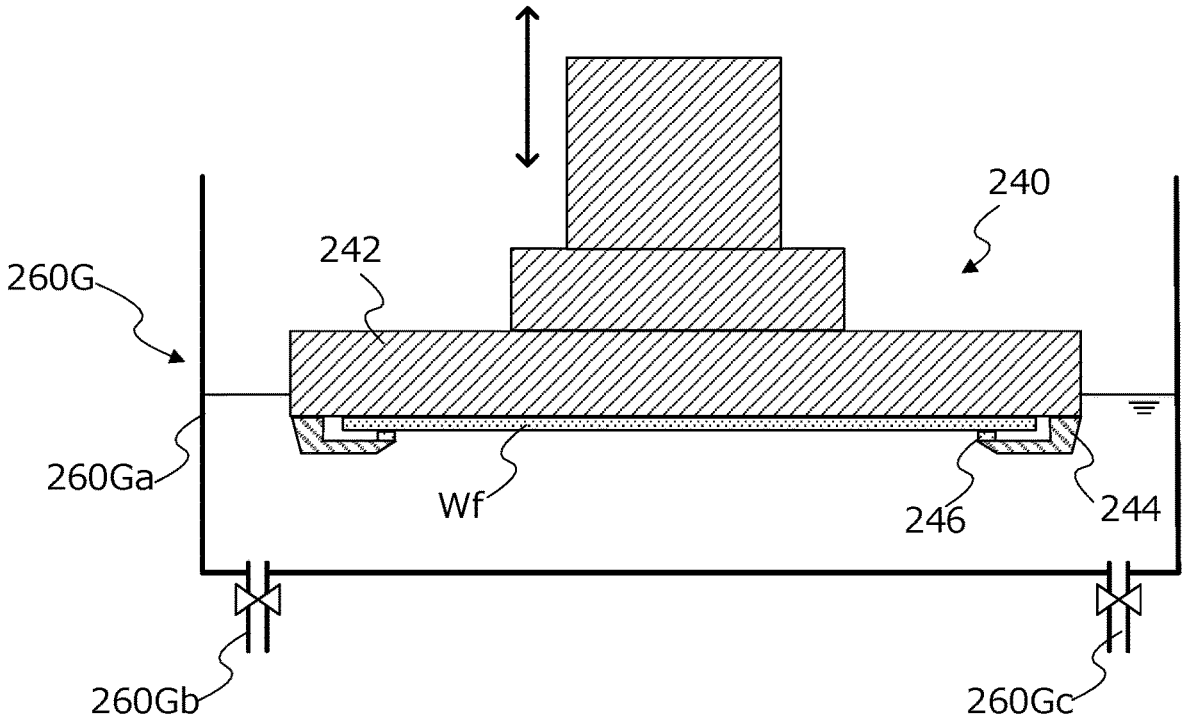
FIG. 12 is a view showing a prewetting treatment of a seventh embodiment by the prewetting module.

FIG. 12 is a view showing a prewetting treatment of a seventh embodiment by the prewetting module 200. In an example shown in FIG. 12, the substrate Wf is held so that the surface to be plated Wf-a faces downward. In the example shown in FIG. 12, the prewetting module 200 includes, as a treatment liquid supply mechanism 260G, a prewetting tank 260Ga for storing a treatment liquid, a treatment liquid supply line 260Gb for supplying the treatment liquid to the prewetting tank 260Ga, and a treatment liquid discharge line 260Gc for discharging the treatment liquid from the prewetting tank 260Ga. In the example shown in FIG. 12, the treatment liquid is adhered to the part to be plated Wf-1 of the substrate Wf by immersing the prewetting substrate holder 240 holding the substrate Wf into the treatment liquid accumulated in the prewetting tank 260Ga by use of the drive mechanism 250 (not shown in FIG. 12). Alternatively, the prewetting module 200 may adhere the treatment liquid to the substrate Wf by moving the prewetting substrate holder 240 into the prewetting tank 260Ga, and then supplying the treatment liquid from the treatment liquid supply line 260Gb into the prewetting tank 260Ga. Alternatively, the prewetting module 200 may adhere the treatment liquid to the substrate Wf by moving the prewetting substrate holder 240 into the prewetting tank 260Ga in a state where the treatment liquid is accumulated in the prewetting tank 260Ga. Furthermore, in the prewetting module 200, the substrate Wf may be tilted in the prewetting tank 260Ga. Alternatively, the prewetting module 200 may move the prewetting substrate holder 240 and the substrate Wf into the prewetting tank 260Ga in a state where the substrate Wf is tilted. In this case, bubbles can be inhibited from being generated in the surface to be plated Wf-a of the substrate Wf. As described above, the substrate Wf is sealed with the seal body 246 of the prewetting tank 260Ga, and hence, also in this example, the treatment liquid can be suitably adhered to the substrate Wf. In addition, in the example shown in FIG. 12, the prewetting module 200 may include one of the jetting mechanisms 260A to 260C shown in FIGS. 6 to 8 disposed so that the jetting port faces upward in place of or in addition to the treatment liquid supply line 260Gb.

When the treatment liquid is adhered to the surface to be plated Wf-a of the substrate Wf in the prewetting treatment as described with reference to FIGS. 6 to 12, the prewetting module 200 subsequently releases the holding of the substrate Wf by the prewetting substrate holder 240. Consequently, the sealing of the surface to be plated Wf-a that is sealed with the first seal body 246 of the prewetting substrate holder 240 is also released. Here, when the holding of the substrate Wf by the prewetting substrate holder 240 is released, it is preferable that the substrate Wf is rotated by the drive mechanism 250 and then the holding of the substrate Wf is released. Alternatively, the prewetting module 200 may perform at least one of moving the substrate Wf in the horizontal direction or the vertical direction, tilting the substrate Wf, and vibrating the substrate Wf in place of or in addition to rotating the substrate Wf. In this case, the treatment liquid remaining around the seal body 246 of the prewetting substrate holder 240 can be reduced, and the treatment liquid can be inhibited from being adhered to the edge portion Wf-2 of the substrate Wf during the releasing of the sealing of the surface to be plated Wf-a. In addition, as shown in FIG. 4, when the second holding member 244 (stepped portion) of the prewetting substrate holder 240 is configured to have a diameter increasing as being away from the surface to be plated Wf-a, it is easy to reduce the treatment liquid remaining around the seal body 246. Also, when the holding of the substrate Wf by the prewetting substrate holder 240 is released in the state where the surface to be plated Wf-a faces downward, the treatment liquid can be further inhibited from being adhered to the edge portion Wf-2 of the substrate Wf.

<Plating Method>

Figure 13:
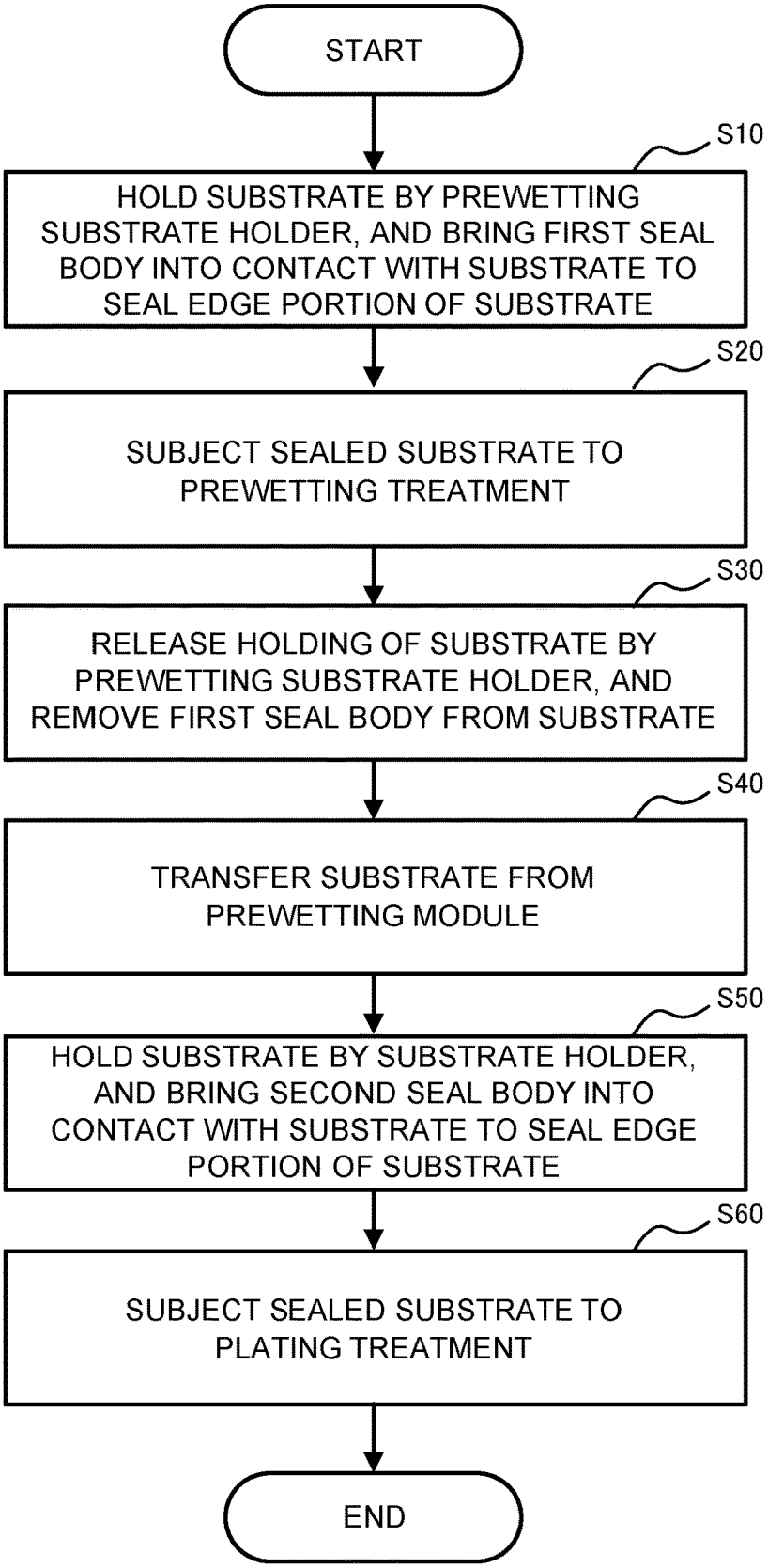
FIG. 13 is a flowchart showing an example of a plating method by the plating apparatus.

FIG. 13 is a flowchart showing an example of a plating method by the above plating apparatus. As shown in FIG. 13, according to the plating apparatus, the prewetting module 200 holds the substrate Wf by the prewetting substrate holder 240, and accordingly brings the seal body (first seal body) 246 into contact with the substrate Wf to seal the edge portion Wf-2 of the substrate Wf (step S10). Subsequently, the module subjects the substrate Wf held by the prewetting substrate holder 240 to the prewetting treatment (step S20). Subsequently, the transfer device 700 transfers the substrate Wf subjected to the prewetting treatment to the presoaking module 300. In addition, it is preferable that the transfer device 700 transfers the substrate Wf to the presoaking module 300 in a state where the substrate is held by the prewetting substrate holder 240. Consequently, in the presoaking treatment, a treatment liquid (presoaking liquid) of sulfuric acid, hydrochloric acid or the like can be prevented from being adhered to the edge portion of the substrate Wf in the presoaking treatment. In addition, the presoaking treatment may be skipped, and the plating apparatus 1000 does not have to include the presoaking module 300. Alternatively, as an example, the prewetting treatment and the presoaking treatment may be performed in the prewetting module 200 by mixing sulfuric acid, hydrochloric acid or the like with the prewetting liquid in the prewetting module 200. Afterward, the holding of the substrate Wf by the prewetting substrate holder 240 is released, and the seal body 246 is removed from the substrate Wf (step S30). The transfer device 700 transfers the substrate Wf subjected to the prewetting treatment to the plating module 400 (step S40). At this time, as an example, the transfer device 700 may transfer the substrate Wf in a state where the surface to be plated Wf-a is oriented downward. In this case, a foreign substance such as the treatment liquid in the prewetting treatment can be prevented from being adhered to the edge portion of the substrate Wf. Then, in the plating module 400, the substrate Wf is held by the substrate holder 440 including a seal body (second seal body) 441 (step S50), and the plating solution is applied to the substrate Wf (step S60). According to this plating method, the substrate Wf can be sealed with the first seal body 246 and subjected to the prewetting treatment, and the treatment liquid in the prewetting treatment can be prevented from remaining in the edge portion Wf-2 of the substrate Wf.

<Modification>

Figure 14:
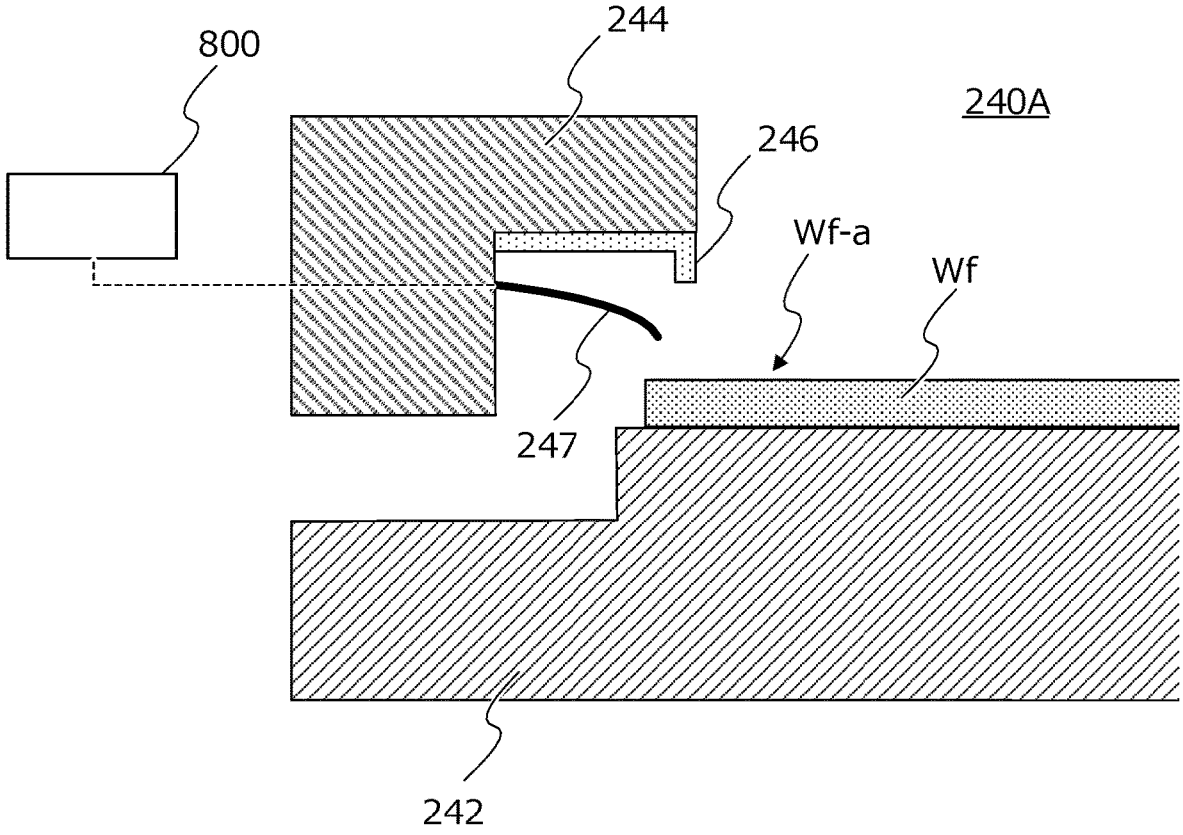
FIG. 14 is a view schematically showing a part of a configuration of a prewetting module according to a modification.

FIG. 14 is a view schematically showing a part of a configuration of a prewetting module according to a modification. FIG. 14 shows an enlarged part of a prewetting substrate holder 240A of the modification. The prewetting substrate holder 240A of the modification includes an electrical contact point 247 (an example of a resistance measuring mechanism) that comes in contact with an edge portion Wf-2 of a held substrate Wf. The prewetting substrate holder 240A includes a plurality of electrical contact points 247, and the plurality of electrical contact points 247 are electrically connected to one another through a conductive layer (e.g., a seed layer) of the substrate Wf. Then, a control module 800 measures a combined resistance through two electrical contact points 247, and determines that there is abnormality in connection between the electrical contact point 247 and the conductive layer of the substrate Wf in a case where the combined resistance is not in a predetermined allowable range. According to the prewetting module of the modification, a defect in the substrate Wf can be detected before the substrate Wf is transferred to the plating module 400.

The present invention can be described in aspects as follows.

[Aspect 1]

According to Aspect 1, a plating method for subjecting a substrate to a plating treatment is provided, the substrate including a part to be plated that is exposed to a plating solution and an edge portion that is an outer region of the part to be plated, the plating method including a first sealing step of bringing a first seal body into contact with the substrate to seal the edge portion of the substrate, a prewetting step of subjecting, to a prewetting treatment, the substrate sealed by the first sealing step, a first seal removing step of removing the first seal body from the prewetted substrate, a substrate holding step of holding the substrate with a substrate holder including a second seal body, and a plating step of applying the plating solution to the substrate held by the substrate holder.

According to Aspect 1, a prewetting liquid can be prevented from remaining in the edge portion of the substrate.

[Aspect 2]

According to Aspect 2, in Aspect 1, the first seal removing step includes a step of rotating the substrate before removing the first seal body from the substrate.

According to Aspect 2, the prewetting liquid remaining around the first seal body can be reduced, and the prewetting liquid can be more prevented from remaining in the edge portion of the substrate.

[Aspect 3]

According to Aspect 3, in Aspect 1 or 2, in the prewetting step, the substrate is subjected to the prewetting treatment in a state where a surface to be plated is oriented downward.

According to Aspect 3, the prewetting liquid can be more prevented from remaining in the edge portion of the substrate.

[Aspect 4]

According to Aspect 4, in Aspect 1 or 2, in the prewetting step, the substrate is subjected to the prewetting treatment in a state where a surface to be plated is oriented upward.

According to Aspect 4, the prewetting liquid can be uniformly adhered to the surface to be plated of the substrate by use of a small amount of prewetting liquid.

[Aspect 5]

According to Aspect 5, in Aspect 4, the prewetting step includes a step of accumulating a prewetting liquid in a tank-shaped region defined by the first seal body and a surface to be plated of the substrate.

According to Aspect 5, the prewetting liquid can be uniformly adhered to the surface to be plated of the substrate by use of a small amount of prewetting liquid.

[Aspect 6]

According to Aspect 6, in Aspects 1 to 5, the method further includes a step of transferring, by a transfer module, the substrate from a place where the substrate is subjected to the prewetting step in a state where a surface to be plated of the substrate is oriented downward.

According to Aspect 6, the prewetting liquid or another foreign substance can be prevented from being adhered to the edge portion of the substrate during the transfer.

[Aspect 7]

According to Aspect 7, in Aspects 1 to 6, the prewetting step is performed by spraying a prewetting liquid to a surface to be plated of the substrate.

[Aspect 8]

According to Aspect 8, in Aspects 1 to 7, the prewetting step is performed in response to rotation of the substrate.

According to Aspect 8, the prewetting liquid can be more uniformly adhered to the substrate.

[Aspect 9]

According to Aspect 9, in Aspects 1 to 8, in the first sealing step, the substrate is held by a prewetting substrate holder including the first seal body, and the prewetting substrate holder includes a supporter that supports a back surface of a surface to be plated of the substrate, and holds the substrate by holding the substrate between the supporter and the first seal body and/or with a vacuum chuck disposed in the supporter.

[Aspect 10]

According to Aspect 10, in Aspect 9, the prewetting substrate holder includes a resistance measuring mechanism that measures an electric resistance of a conductive layer of the edge portion of the substrate, and the plating method further includes a step of measuring the electric resistance of the substrate held by the prewetting substrate holder.

According to Aspect 10, a defect of the substrate can be detected prior to the plating step.

[Aspect 11]

According to Aspect 11, in Aspects 1 to 10, in a surface to be plated of the substrate, a stepped portion including the first seal body is formed, and the stepped portion is formed in a tapered shape with a diameter increasing as being away from the surface to be plated of the substrate.

According to Aspect 11, the prewetting liquid can be more prevented from remaining in the edge portion of the substrate.

[Aspect 12]

According to Aspect 12, in Aspects 1 to 11, in the plating step, the substrate holder and the substrate are immersed into the plating solution in a state where a surface to be plated is oriented downward.

According to Aspect 12, the prewetting liquid can be more prevented from remaining in the edge portion of the substrate.

The embodiments of the present invention have been described above, but the above embodiments of the present invention are described to facilitate understanding of the present invention, and are not intended to limit the present invention. Needless to say, the present invention may be changed or modified without departing from the spirit, and the present invention includes equivalents to the invention. Also, in a range in which at least some of the above-described problems can be solved or a range in which at least some of effects are exhibited, any arbitrary combination of the embodiments and the modification is possible, and arbitrary combination or omission of respective constituent components described in claims and description is possible.

The present application claims the benefit of priority based on Japanese Patent Application No. 2020-171311 filed on Oct. 9, 2020. All disclosed contents including the description, claims, drawings and abstract of Japanese Patent Application No. 2020-171311 are entirely incorporated herein by reference. All disclosure including the description, claims, drawings and abstract of Japanese Patent Laid-Open No. 2001-316869 (Patent Literature 1) is entirely incorporated herein by reference.

REFERENCE SIGNS LIST

200 prewetting module
240 and 240A prewetting substrate holder
242 first holding member
244 second holding member
245 pin
246 seal body (first seal body)
247 electrical contact point
250 drive mechanism
260A to 260C and 260F jetting mechanism
260D, 260E and 260G treatment liquid supply mechanism
400 plating module
410 plating tank
440 substrate holder
441 seal body (second seal body)
800 control module
1000 plating apparatus
Wf substrate
Wf-a surface to be plated
Wf-1 part to be plated
Wf-2 edge portion

What is claimed is:

1. A plating method for subjecting a substrate to a plating treatment, the substrate including a part to be plated that is exposed to a plating solution and an edge portion that is an outer region of the part to be plated, the plating method comprising:

a first sealing step of bringing a first seal body into contact with the substrate to seal the edge portion of the substrate, a prewetting step of subjecting, to a prewetting treatment, the substrate sealed by the first sealing step, a first seal removing step of removing the first seal body from the prewetted substrate, a substrate holding step of holding the substrate with a substrate holder including a second seal body, and a plating step of applying the plating solution to the substrate held by the substrate holder, wherein in the first sealing step, the substrate is held by a prewetting substrate holder including the first seal body, the prewetting substrate holder includes a supporter that supports a back surface of a surface to be plated of the substrate, and holds the substrate by holding the substrate between the supporter and the first seal body and/or with a vacuum chuck disposed in the supporter, the prewetting substrate holder comprises a resistance measuring mechanism that measures an electric resistance of a conductive layer of the edge portion of the substrate, and the plating method further comprising:

a step of measuring the electric resistance of the substrate held by the prewetting substrate holder.

2. The plating method according to claim 1, wherein the first seal removing step includes a step of rotating the substrate before removing the first seal body from the substrate.

3. The plating method according to claim 1, wherein in the prewetting step, the substrate is subjected to the prewetting treatment in a state where a surface to be plated is oriented downward.

4. The plating method according to claim 1, wherein in the prewetting step, the substrate is subjected to the prewetting treatment in a state where a surface to be plated is oriented upward.

5. The plating method according to claim 4, wherein the prewetting step includes a step of accumulating a prewetting liquid in a tank-shaped region defined by the first seal body and a surface to be plated of the substrate while the substrate is stopped.

6. The plating method according to claim 1, further comprising:

a step of transferring, by a transfer module, the substrate from a place where the substrate is subjected to the prewetting step in a state where a surface to be plated of the substrate is oriented downward.

7. The plating method according to claim 1, wherein the prewetting step is performed by spraying a prewetting liquid to a surface to be plated of the substrate.

8. The plating method according to claim 1, wherein the prewetting step is performed in response to rotation of the substrate.

9. The plating method according to claim 1, wherein in a surface to be plated of the substrate, a stepped portion including the first seal body is formed, and the stepped portion is formed in a tapered shape with a diameter increasing as being away from the surface to be plated of the substrate.

10. The plating method according to claim 1, wherein in the plating step, the substrate holder and the substrate are immersed into the plating solution in a state where a surface to be plated is oriented downward.

* * * * *